United States Patent [19]

Sohma

[11] Patent Number: 4,811,896

[45] Date of Patent: Mar. 14, 1989

[54] BOTTLE WRAPPER

[75] Inventor: Yoriko Sohma, Marshfield, Mass.

[73] Assignee: Sanpho America, Inc., Boston, Mass.

[21] Appl. No.: 187,596

[22] Filed: Apr. 28, 1988

[51] Int. Cl.[4] ..... B65D 65/00

[52] U.S. Cl. ..... 229/89; 229/8

[58] Field of Search ..... 229/89, 90, 91, 87 R, 229/8

[56] References Cited

U.S. PATENT DOCUMENTS

| | | | |
|---|---|---|---|
| 1,951,019 | 3/1934 | Hoffman et al. | 229/89 |
| 2,112,477 | 3/1938 | Brownfield | 229/89 |
| 4,176,700 | 12/1979 | Mettler et al. | 229/8 |

FOREIGN PATENT DOCUMENTS

| | | | |
|---|---|---|---|
| 578440 | 5/1933 | Fed. Rep. of Germany | 229/89 |
| 813437 | 7/1951 | Fed. Rep. of Germany | 229/89 |

*Primary Examiner*—Willis Little

*Attorney, Agent, or Firm*—Lorusso & Loud

[57] ABSTRACT

A bottle wrapper including a wrapper sheet with a main body engaging portion, a neck engaging portion to provide a decorative arrangement at the top of the wrapped bottle and a bottom engaging portion configured to fit cleanly around the bottom of the bottle. Means are provided to secure the wrapper sheet at the neck and bottom of the bottle.

6 Claims, 3 Drawing Sheets

BOTTLE WRAPPER

BACKGROUND OF THE INVENTION

The present invention is a device for wrapping a bottle of any size in a neat and attractive manner to provide a superior container for the bottle in a commercial or gift display.

There has long been a need for an cost-efficient and attractive means to contain a bottle. Because bottles are generally cylindrical and have a tapered neck, conventional containment means, such as square or rectangular boxes, did not answer that need. To provide a close fit for any bottle would require a large variety of box sizes, increasing costs significantly to the manufacturer and thus to the consumer. Containing such a cylindrical bottle in a rectangular box means that large portions of the inside of the box are empty. Consequently, that container is wasteful and may require extra space on a shelf display. Additionally, because of the extra space, the bottle may not be adequately secured and could topple or fall. A marketing problem associated with utilizing boxes for containing items such as expensive liquors and perfumes to be given as gifts is that the recipient of the gift can generally judge what the gift is because of recognition of its container. Furthermore, expensive wines are not marketed in boxes because they are preferably stored on their sides so that the corks will remain moist.

Bottles have also been contained in wrapping paper, especially when given as a gift. While the flat paper wraps easily and neatly around the body of the bottle, wrapping in this manner leaves extra wrapping paper around the tapered neck of the bottle and at the bottom of the bottle. This unattractive wrapping not only wastes paper, but it is also bulky and does not leave a secure base on which to rest the bottle.

More recently, manufacturers have provided bags in which a bottle can be placed for sale or gift-giving. While the wrapping bags solve the problem of bulky wrapping paper edges at the top and bottom of the bottle, they are generally expensive and still do not provide a close or exact fit to the bottle Accordingly, an object of the present invention is to provide a device to wrap bottle that is cost-efficient and space efficient.

It is another object of the present invention to provide a device to wrap a bottle in an attractive manner.

Still another object of the present invention is to provide a device to wrap a bottle that will take up a minimum of space in a shelf display and yet will secure the bottle adequately to prevent breakage.

A further object of the present invention is to provide a bottle wrapper that wraps a bottle beautifully and without bulkiness so as to make an attractive gift package.

SUMMARY OF THE INVENTION

The present invention is a device to wrap a bottle in an attractive, relatively inexpensive and space-efficient manner. The bottle wrapper of the present invention includes a wrapper sheet configured to enclose the bottle without waste of material, having a bottle neck-engaging portion configured to form an attractive display on the top of the bottle and a bottom engaging portion configured to cover the bottom of the bottle securely and without waste of paper. The device of the present invention may additionally include means to secure the wrapper sheet around the neck of the bottle and a seal to secure the bottom engaging portion of the wrapper sheet on the bottom of the bottle.

DETAILED DESCRIPTION OF THE INVENTION

The present invention is a device to wrap a bottle attractively, easily and without waste of the wrapping material. The bottle wrapper of the present invention can be used with various shapes and sizes of bottles. Moreover, with changes to the configuration or material of each of the elements of the bottle wrapper, or by addition of decals, ribbons and other ornamental items, the bottle wrapper presents many different and interesting decorative ways to display a bottle or to give one as a gift. The bottle wrapper will be of special interest for use with liquor and perfume bottles, as these items are often purchased by consumers with the intent to present them as gifts.

Figure 1:
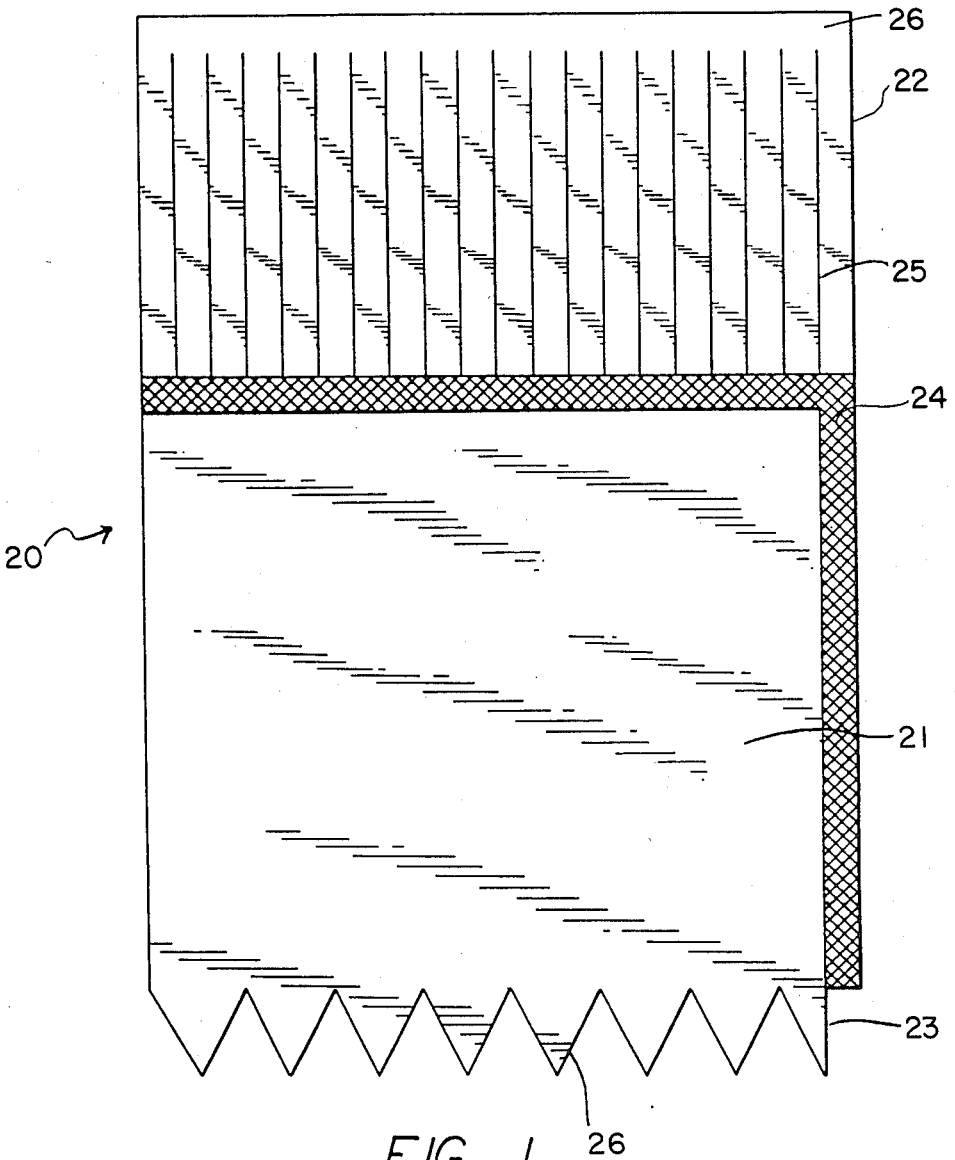
FIG. 1 is a top plan view of the wrapper sheet of the bottle wrapper of the present invention.

FIG. 1 illustrates the wrapper sheet 20 of the present invention. The wrapper sheet 20 may be formed from any material and, in a preferred embodiment, the wrapper sheet will be formed from handmade or machine-made paper. It can easily be seen that changing the paper from which the wrapper sheet 20 is formed will change the decorative aspects of the finished bottle wrapper 10. The wrapper sheet 20 is generally a one-piece configuration and includes a main body engaging portion 1, a neck engaging portion 22, and a bottom engaging portion 23, each element named in reference to the part of bottle which will be wrapped.

The main body engaging portion 21 is an essentially rectangular piece formed from the paper and has a width sized to surround the bottle without excess of paper. It will be observed that the width of the wrapper sheet 20 need not correspond exactly to the width of the bottle because an excess will not affect the fit of the bottle wrapper. Accordingly, the large variety of sizes required in known devices to wrap bottles is not necessary with the bottle wrapper of the present invention. In order to facilitate securing the wrapper sheet 20 to the bottle, means for adhering the wrapping sheet may be provided. As shown in FIG. 1, the top and one side edge of the main body engaging portion 21 will preferably have a strip of adhesive 24. Any adhesive may be used, for example, a pressure sensitive adhesive, a moisture activated adhesive or peel and stick adhesive means can be used with the bottle wrapper 10 of the present invention. Of course, other conventional means may be provided to secure the wrapper sheet 20 while wrapping the bottle, such as decals, strings or even ribbons.

Extending from the top of the main body engaging portion 21 is the neck engaging portion 22. The neck engaging portion 22 is configured to provide a decorative display at the top of the wrapped bottle. In one preferred embodiment, the neck engaging portion 22 extends as a rectangular piece from the main body engaging portion 21, as shown in FIG. 1. Slits 25 extending from the top of the main body engaging portion 21 to below the upper edge of the neck engaging portion 22 are provided forming a slotted area bounded by a non-slotted top edge 26 to provide a decorative display when placed on the bottle, as described below.

Extending from the below the main body engaging portion 21 is the bottom engaging portion 23. The bottom engaging portion 23 is configured to provide a neat, non-bulky finish to the wrap of the bottle so that there is no excess of paper when the wrapping is complete. The wrapped bottle can therefore stand on a shelf or table. A preferred embodiment is shown in FIG. 1 in which the bottom engaging portion 23 is pinked or serrated to form jagged or toothed edges 26 to fit cleanly over the surface of the bottom of the bottle when secured, as will be described below.

Figure 7:
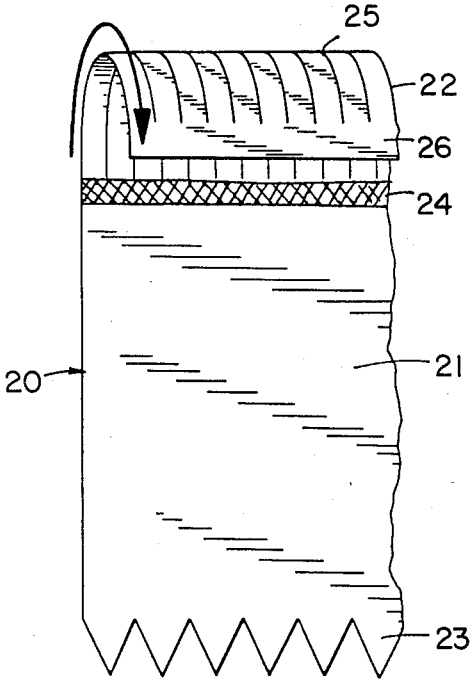
FIGS. 7–10 illustrate a method to use the bottle wrapper of the present invention.
Figure 8:
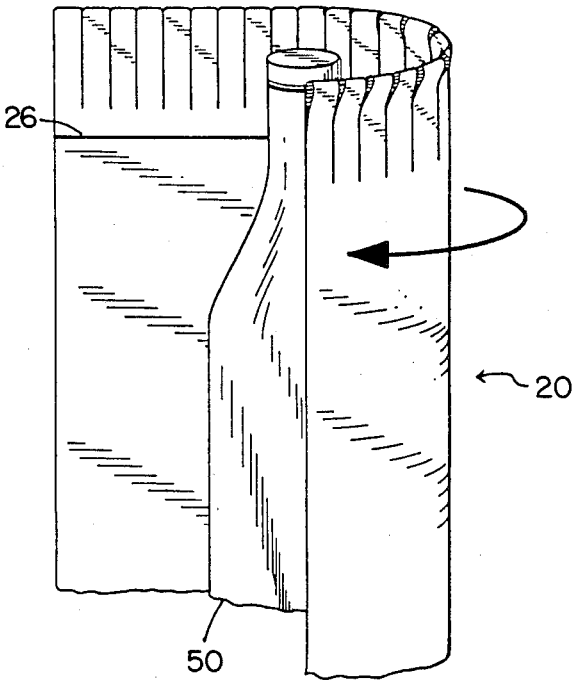

The bottle wrapper 10, of the present invention will be formed as follows. Initially, as shown in FIG. 7, the neck engaging portion 22 is folded over in the direction of the arrow toward the main body engaging portion 21 such that the top non-slotted edge 26 of the neck engaging portion 22 is placed proximal to the adhesive strip 24 on the top edge of the main body engaging portion 21 and is secured. The wrapper sheet 20 is placed next to the bottle 50 to be wrapped, with the folded over secured non-slotted top edge 26 facing the bottle 50. The wrapper sheet 20 is wrapped around the bottle 50, in the direction of the arrow shown in FIG. 8, until the entire bottle 50 is covered with the wrapper sheet 20 and the wrapper sheet 20 is secured by the side adhesive strip 24. In an alternative embodiment, a second seal (not shown) could be provided to secure the wrapper sheet 20.

Figure 3:
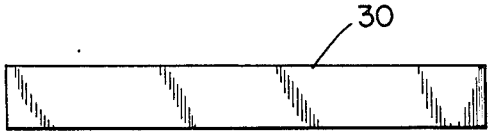
FIG. 3 is a top plan view of one embodiment of the means to secure the wrapper sheet includable with the bottle wrapper of the present invention.
Figure 4:
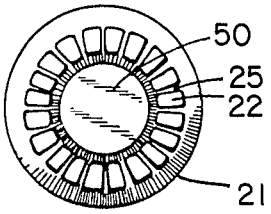
FIG. 4 is a top plan view of the bottle wrapper of the present invention in use.
Figure 9:
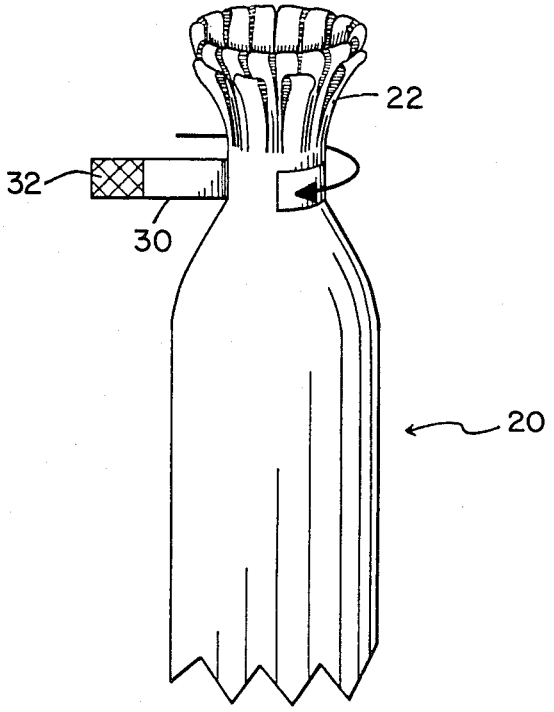

The bottle wrapper 10 of the present invention may include means for securing the wrapper sheet to the neck of the bottle. In one embodiment as shown in FIG. 3, the means for securing the wrapper sheet to the neck of the bottle 30 is simply a band. As shown in FIG. 9, the neck engaging portion 22 is secured to the neck of the bottle by wrapping the band 30 around the neck of the bottle after the wrapper sheet 20 is in place. The band 30 may be provided with adhesive means 32 to secure it to the bottle neck, for example an adhesive activated by moisture or pressure or a peel and stick adhesive patch. Of course, the means for securing the wrapper sheet to the neck of the bottle 30 can vary, depending on the decorative effect desired. For example, it can be a bow, a ribbon, a yarn or even a band formed to take on the shape of any of those items. When the means for securing the wrapper sheet to the neck of the bottle 30 is in place, the neck-engaging portion 22 of the wrapper sheet 20 surrounds the neck of the bottle, and fans out due to the slits 25 provided. A flower like appearance results. FIG. 4 is a view from the top of the bottle with the slotted neck engaging portion surrounding the bottle neck.

Figure 2:
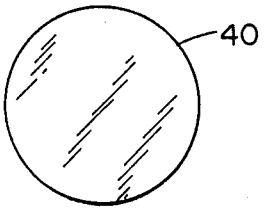
FIG. 2 is a top plan view of one embodiment of a seal includable with the bottle wrapper of the present invention.
Figure 5:
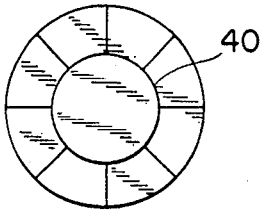
FIG. 5 is a bottom plan view of the bottle wrapper of the present invention in use.
Figure 10:
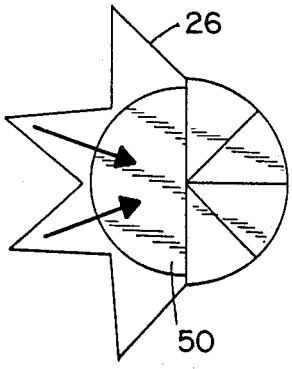

Turning to the bottom of the bottle, as the wrapper sheet 20 surrounds the bottle, each toothed edge 26 extend downwardly from the perimeter of the bottom edge of the bottle. To complete the bottle wrap, the toothed edges 26 are folded onto the bottom surface of the bottle 50, one after another, until they all lie flat on that surface, as shown in FIG. 10. The seal 40 may then adhered to folded edges to secure them. The seal 40, in the embodiment shown in FIG. 2, is a generally round flat applique which will secure the folded edges of the wrapper sheet at the bottom of the bottle. Accordingly, the seal 40 includes two surfaces, a top surface that is decorative and the opposite surface coated with an adhesive material for securing the wrapper sheet to the bottle. FIG. 5 shows the seal 40 in place on the wrapped bottle.

Figure 6:
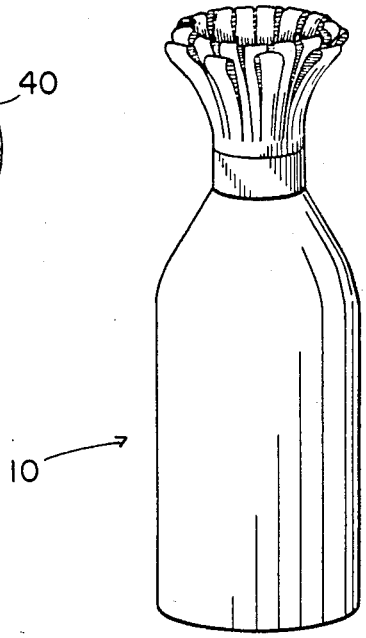
FIG. 6 is a side plan view of the bottle wrapper of the present invention in use.

The bottle wrapper 10 in use on a bottle is shown in FIG. 6. As can be seen, the slits 25 in the neck engaging portion 22 provide a pleasing, almost flower-like appearance at the top of the bottle. The means for securing the neck of the bottle fits neatly around that part of the bottle. Additionally, the wrapping does not bulk at the bottom of the bottle, due to the configuration of the toothed edges of the bottom engaging portion of the wrapper sheet. The bottle will rest securely on a shelf or table as there is no excess material at this surface.

The foregoing description should be taken as illustrative, and should not be considered as limiting in any sense. Modifications and adaptations within the spirit of the invention will be evident to one skilled in the art.

What is claimed is:

1. A sheet for forming a package for containing a bottle comprising:

a wrapper sheet, said wrapper sheet having a bottom portion adapted to be folded over to form a generally circular bottom of a package for containing the bottle, a top portion of said wrapper sheet opposite said bottom portion having a series of slits, said series of slits not extending to the top edge of the wrapper sheet and forming a slotted section of the wrapper sheet adapted to be folded over at the neck of the bottle, said wrapper sheet further including adhesive means to form a generally cylindrical package for containing a bottle.

2. The sheet for forming a package for containing a bottle of claim 1 further comprising:

a seal for securing said wrapper sheet to the bottom of the bottle; and means for securing said wrapper sheet to the neck of the bottle.

3. The sheet for forming a package for containing a bottle of claim 1 wherein the bottom portion of said wrapper sheet is pinked to form toothed edges.

4. The sheet for forming a package for containing a bottle of claim 1 wherein said adhesive means comprises a strip of adhesive extending along one side edge of said wrapper sheet and a second strip of adhesive extending across said wrapper sheet below the slotted section of said wrapper sheet.

5. A method for attractively wrapping a bottle comprising:

providing a wrapper sheet, said wrapper sheet having a bottom portion pinked to form toothed edges, a top portion of said wrapper sheet opposite said bottom portion having a series of slits not extending to the top edge of said wrapper sheet and forming a slotted section of the wrapper sheet, and a strip of adhesive extending along one side edge of the wrapper sheet and a second strip of adhesive extending across the wrapper sheet below the slotted section of the wrapper sheet;

folding the top edge of the wrapper sheet over to the second strip of adhesive and securing the top edge thereto to form a looped section;

placing the folded wrapper sheet around the bottle so that the looped section is in the area of the neck of the bottle and so that the two side edges of the wrapper sheet are curvable toward each other in a generally cylindrical shape;

securing the wrapper sheet to the bottle by adhering the two side edges;

folding the toothed edges over onto the bottom surface of the bottle;

securing the toothed edges of the wrapper sheet; and securing the looped section to the neck of the bottle so that the loops form a pleasing appearance around the top of the bottle.

6. The method of claim 5 wherein the toothed edges of the wrapper sheet are secured with a decorative seal and the loop section is secured to the neck of the bottle with a band.

* * * * *